United States Patent [19]

Karamarkovich

[11] 4,014,226

[45] Mar. 29, 1977

[54] PLIERS WITH MODIFIED JAWS FOR USE IN AUTO BODY REPAIR

[75] Inventor: John Karamarkovich, Pittsburgh, Pa.

[73] Assignee: The Raymond Lee Organization, Inc., a part interest

[22] Filed: May 4, 1976

[21] Appl. No.: 683,017

[52] U.S. Cl. ..... 81/426; 81/5.1 R

[51] Int. Cl.[2] ..... B25B 7/02

[58] Field of Search ..... 81/418, 420, 421, 422, 81/425 R, 425 A, 426, 5.1; 140/106

[56] References Cited

UNITED STATES PATENTS

| | | | |
|---|---|---|---|
| 1,411,823 | 4/1922 | Weller | 81/5.1 |
| 1,469,696 | 10/1923 | Raez | 81/418 |
| 1,782,364 | 11/1930 | Nation | 81/426 |
| 2,212,801 | 8/1940 | Torbert | 81/426 |

*Primary Examiner*—James L. Jones, Jr.

[57] ABSTRACT

A pair of pliers have two opposed jaws. The first jaw has an inner working surface with two flat sections that meet in an obtuse angle to form an indentation. The second jaw has a sharply defined peak that meets the point of connection of the two sections when the jaws are closed. When a piece of sheet metal is introduced between the jaws and the handles are squeezed shut, the edge of the piece is displaced parallel to the rest of the piece.

3 Claims, 3 Drawing Figures

PLIERS WITH MODIFIED JAWS FOR USE IN AUTO BODY REPAIR

BACKGROUND OF THE INVENTION

When repairing a hole in a piece of sheet metal in an automobile body, the metal all along the periphery of the hole is "indented" inwardly, to form a short shelf all around the hole. A flat piece of metal is then attached to the shelf with blind, or "pop" rivets. The depressed section thus created is then filled in with putty to slightly above the level of the original surface, sanded smooth, and painted.

It can readily be seen that the job of riveting the piece of metal to the shelf will be made easier if the shelf occupies a flat plane more or less parallel to the original surface.

SUMMARY OF THE INVENTION

This invention is directed towards a pair of pliers that will make it easy to form a shelf with the desired flatness.

Essentially, this invention is a specialized pair of pliers designed for crimping metal. When this invention is used around the perimeter of a hole in a piece of sheet metal, it bends the edge of the metal into two sections: a downwardly and inwardly sloping section and a slightly longer shelf section, the latter being generally parallel to the original surface of the piece of sheet metal.

To do this, the jaws of the pliers are not corrugated as jaws of conventional pliers are. Rather, one of the jaws is a sort of die, with a working surface that has two flat planes cut into it to form an indentation. The other jaw is a lever that forces the sheet metal to conform to the shape of the first jaw.

DETAILED DESCRIPTION OF PREFERRED EMBODIMENT

Figure 1:
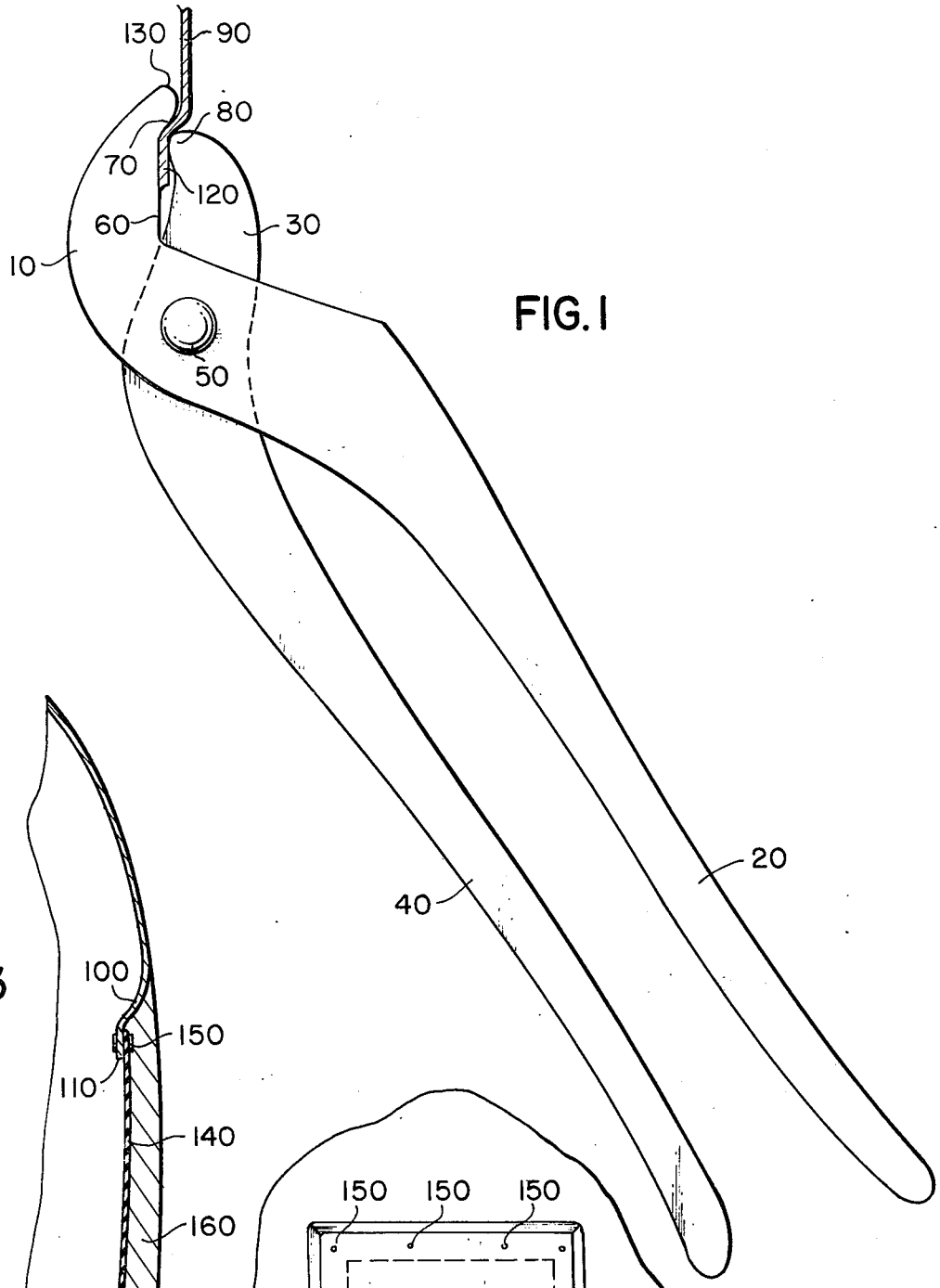
FIG. 1 is a side view of the invention in use.

A first jaw 10 and an elongated handle 20 are integrally molded together, as are second jaw 30 and elongated handle 40. The two members thus formed cross each other intermediate their ends and are pivotally secured together via rivet 50. Thus, squeezing the handles together squeezes the jaws together.

The first jaw has an inner working surface composed of sections 60 and 70. Both surfaces are flat, and meet at an obtuse angle, with section 70 being shorter than and extending forwardly of section 60. An indentation is thus formed in the inner surface of jaw 10 which will serve as a die.

Figure 3:
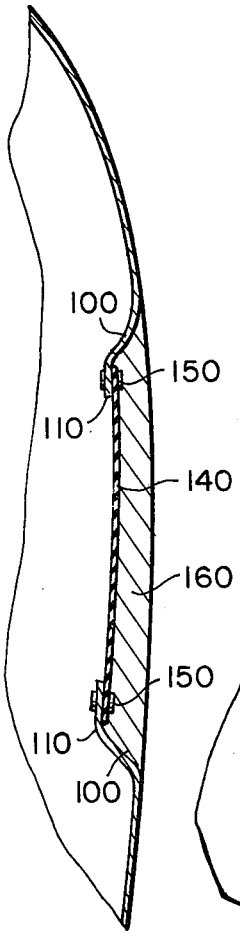
FIG. 3 is a side view of FIG. 2.
Figure 2:
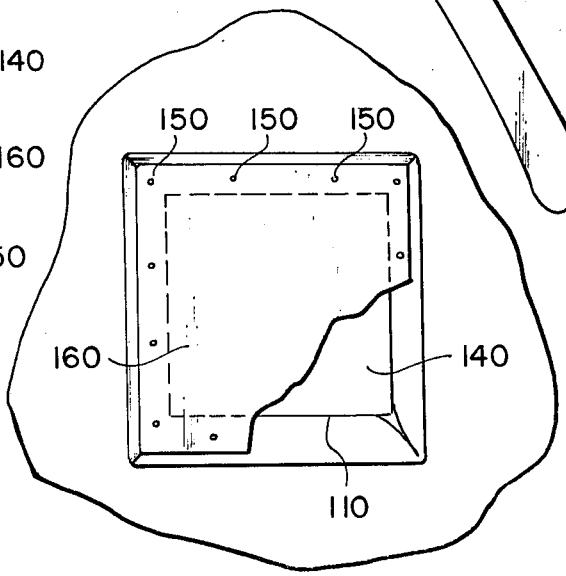
FIG. 2 is a front view of a repair made by using the invention.

Jaw 30 has a sharply defined peak 80 that, when the jaws are closed, touches the line that separates sections 60 and 70. It can be seen that when a piece of sheet metal 90 is inserted between the jaws and the jaws are squeezed together, the peak in jaw 30 forces the metal against the working surface of jaw 10, indenting the metal. Thus, in FIG. 3, the downwardly and inwardly sloping sections 100 were produced by section 70, and the flat shelf 110 was produced by section 60. It is to be noted that, as is shown in FIG. 1, the section 120 of metal that is indented is generally parallel to the section 130 of the piece of metal that never entered the pliers. This is made possible by the blunted forward tip 130 of jaw 10, that allows the user to rock the invention in that direction which will allow the general parallelism between the indented sections of the metal and the original unbent sections to remain intact.

As is conventional practice, a flat piece 140 of metal may be attached to the shelf by blind, or "pop" rivets 150. The resulting depressed area is filled with putty 160 and sanded down to the original level of the surface. The repaired area may thus be painted.

Although the invention has been described with particular reference to the drawings, the protection sought is to be limited only by the terms of the claims which follow.

What is claimed is:

1. A pair of pliers with specially shaped jaws designed for indenting sheet metal comprising a conventional pair of pliers with elongated handles and first and second opposed jaws pivotally secured together so that squeezing the handles together causes the jaws to be squeezed together, the first jaw having an inner working surface with a first flat section and a shorter second flat working section that is attached to the front of the first section and makes an obtuse angle with respect to it, and the second jaw having an inwardly extending sharply defined peak that touches the point of connection of the two sections of the inner working surface when the jaws are closed.

2. The device of claim 1 wherein the forward tip of the first jaw is rounded off to form a beak.

3. The device of claim 2 wherein each handle is integrally molded with a corresponding jaw.

* * * * *